US005456166A

United States Patent [19]

Belongia et al.

[11] Patent Number: 5,456,166

[45] Date of Patent: Oct. 10, 1995

[54] CAN CRUSHER WITH SAFE ENTRY AND DISCHARGE CHUTES

[75] Inventors: David C. Belongia, West Bend; Sally K. Cashin, Wauwatosa, both of Wis.

[73] Assignee: The West Bend Company, West Bend, Wis.

[21] Appl. No.: 292,063

[22] Filed: Aug. 17, 1994

Related U.S. Application Data

[63] Continuation of Ser. No. 983,660, Dec. 1, 1992, abandoned.

[51] Int. Cl.[6] ..... B30B 9/32

[52] U.S. Cl. ..... 100/53; 100/215; 100/218; 100/902

[58] Field of Search ..... 100/52, 53, 215, 100/216, 218, 902

[56] References Cited

U.S. PATENT DOCUMENTS

| | | | |
|---|---|---|---|
| 2,369,305 | 2/1945 | Lobasso | 100/218 X |
| 2,866,605 | 12/1958 | Picone | 100/902 X |
| 4,240,341 | 12/1980 | Whipple et al. | 100/215 X |
| 4,265,170 | 5/1981 | Schulze, Jr. | 100/215 X |
| 4,296,683 | 10/1981 | Lidik et al. | 100/902 X |
| 4,459,906 | 7/1984 | Cound et al. | 100/902 X |
| 4,550,658 | 11/1985 | Trolle | 100/215 |
| 4,771,685 | 9/1988 | Wagner | 100/218 X |

FOREIGN PATENT DOCUMENTS

| | | | |
|---|---|---|---|
| 58-77796 | 5/1983 | Japan | 100/902 |
| 59-50998 | 3/1984 | Japan | 100/902 |
| 853315 | 11/1960 | United Kingdom | 100/218 |
| 81/02802 | 10/1981 | WIPO | 100/902 |

*Primary Examiner*—Stephen F. Gerrity
*Attorney, Agent, or Firm*—Jansson & Shupe, Ltd.

[57] ABSTRACT

A can crusher is provided with a can feed hopper having an open inlet at the top of the can crusher through which opening a plurality of cans may be inserted one after another to fill the hopper. Sequentially, each can falls by gravity into a crushing compartment where a power-driven ram crushes the can axially to crumple the can's cylindrical wall thereby reducing the can's length to about one-fourth or less of its original length. The crushed can falls by gravity through a discharge chute to be automatically discharged. Each can in the hopper automatically falls in succession into the crushing compartment to be crushed and discharged. To prevent human fingers from being inserted through the hopper inlet or the discharge chute and into the crushing compartment, the guiding chute paths are non-linear and/or tortuous to reduce the length thereof and to block a straight finger insertion into the crushing compartment. To remove an uncrushed can from the crushing compartment, the can feed hopper may be detached; and this detachment operation automatically operates an electrical switch to disable a power drive for the ram to thereby prevent crushing of the human fingers removing the uncrushed can.

12 Claims, 3 Drawing Sheets

CAN CRUSHER WITH SAFE ENTRY AND DISCHARGE CHUTES

RELATED APPLICATION

This application is a continuation of application Ser. No. 07/983,660 filed Dec. 1, 1992 and now abandoned.

BACKGROUND OF THE INVENTION

This invention relates to a power-operated can crusher for crushing cans, and more particularly, to a can crusher for use in the home for crushing aluminum cans.

The present invention is directed to a can crusher that is intended to be purchased for use in a home for crushing cans made of aluminum such as the typical soft drink or beverage cans. With recycling of cans, there is a desire to crush cans to a small fraction of their uncrushed size for placing in recycling containers. Manually operated can crushers are available and require the operator to supply the force by pulling a lever to crush the can. Some power-operated can crushers are available in which a crusher ram is driven by an electric motor to crush a can within the can crusher. These power-operated can crushers crush the can within a crushing chamber access to which is by means of a door. In use, the door is opened and a can is inserted into the crushing chamber, and the door is closed. The ram is driven by the electric motor to crush the can and the door is again opened to remove the can. A safety interlock prevents operation of the crusher ram while the door is open to prevent crushing of human fingers by operation of the crushing ram.

In some instances, a steel can may be inserted into a conventional can crusher, and the crusher ram is operated without crushing the steel can. In such instances, the can is often jammed by the ram with a stalled motor drive forcing the ram tightly against the steel can, which may be partially compressed. One known can crusher requires a very difficult and time-consuming reverse movement of a drive train for the crusher ram in order to back off the ram to release the jammed steel can. It is not recommended that a screw driver or other instrument be used to pry the jammed can loose because the screw driver may puncture the can, and release any liquid therein.

The present invention is directed to providing a much faster and more convenient can crusher in which a plurality of cans can be loaded and fed sequentially into the can crusher through an uncovered opening. That is, the opening is not covered by a door that needs to be opened and closed for a single can crushing operation. This door opening and closing, and waiting until the previous can is crushed before inserting a second can renders the can crushing task tedious particularly where one wants to crush a plurality of cans with a minimum of effort. The present invention is also directed to providing an automatic discharge of crushed cans from a discharge opening without having to open a door for each crushed can, as in the above-described, conventional can crusher.

The present invention is also directed to meeting certain Underwriter Laboratories' safety criteria that specify restrictions with respect to the size of opening and relative length of path from the exterior of the can crusher to the crushing chamber so that human fingers may not be inserted through a can inlet or a can discharge opening and inserted into the crushing chamber. If the fingers can be placed in the crushing chamber, an operation of the can crusher, whether by an accidental start or as part of an ongoing can crushing sequence, results in fingers being crushed. The can crusher needs a fairly large inlet opening to receive a can; and a hand can be easily inserted therein. This can crusher which is for use in the home, cannot be so large as to provide a linear inlet chute longer than a arm. In order to be marketable, these can crushers cannot take a large amount of limited counter space in a kitchen or the like. Also, these can crushers should be of a size to be mounted on a wall in a kitchen or the like. Thus, in order for the can crusher to be commercially successful, it must be limited in size.

Thus, it is an object of the present invention to provide a new and improved, power-operated can crusher for home usage.

Another object of the invention is to provide a can crusher in which cans are rolled from an open inlet to a crushing compartment, and then automatically crushed and discharged from the crushing compartment.

SUMMARY OF THE INVENTION

In accordance with the present invention, a plurality of cans may be loaded into a can feeder or hopper, and the cans will roll automatically into the crushing station one after another, and the crushed cans are automatically discharged from the can crusher. The user may place another can into the can feeder as soon as a crushed can is being discharged. Thus, the user may bring to the can crusher a large number of cans, and without opening and closing doors, feed a continual supply of cans into the can feeder with each of the crushed cans being automatically discharged. In the preferred embodiment, the can feed hopper will hold six cans so that the user will usually be able to load it by rolling six or less cans into the feeder, and leave the can crusher unattended as each of the cans in the feed hopper will roll sequentially into the crushing station, at which place they are crushed and then discharged automatically.

The can feed hopper is removably mounted on a can crusher base unit to allow access to a steel can that will not be crushed by the ram. A safety interlock prevents operation of the ram so that human fingers cannot be accidentally crushed while the can feed hopper is removed. The preferred interlock includes a hidden electrical switch that is actuated by a projection on the can feed hopper that moves internally within the base to activate the circuit for the ram to enable the electric motor when the hopper is attached to the base unit. Conversely, when the can feed hopper is removed from the base unit, the switch is shifted to disable the motor operation of the ram.

The preferred inlet opening for the can, and the discharge opening from the can crusher are uncovered openings. To prevent a child or adult from inserting a hand through the inlet opening to the crushing chamber, the inlet chute is a non-linear chute which prevents a straight insertion of the hand and arm into the unit. The preferred inlet chute has walls that direct the cans to roll down a slope in a first direction, and then roll in a reverse direction before dropping downwardly into the crushing chamber. The hand and fingers cannot make this reversal of direction and reach the crushing chamber. The can discharge opening is a much smaller size opening so that an adult hand cannot be inserted therein. The preferred discharge path is also along a non-linear path so that a hand cannot be inserted straight into the can crusher to the crushing chamber. Preferably, the discharge is a downwardly dropping, curved chute which should defeat any small hand inserted therein from being crushed by the ram.

Preferably, the can crusher can be mounted on a room wall with a back side thereof attached to the wall and with the cans being dropped into an upper inlet opening and with the discharging crushed can dropping automatically from the bottom portion of the can crusher into a recycling container. In the illustrated embodiment of the invention, the cans are dropped into the can inlet at the top side of the crusher and the crushed cans are discharged at a lower discharge aperture in the lower portion of the front side of the can crusher. In this embodiment, the cans travel in a downward path with one edge of the can traveling in a substantially vertical plane as it travels through the can feed hopper, the crushing chamber and the discharge chute.

DETAILED DESCRIPTION OF THE PREFERRED EMBODIMENT

Figure 1:
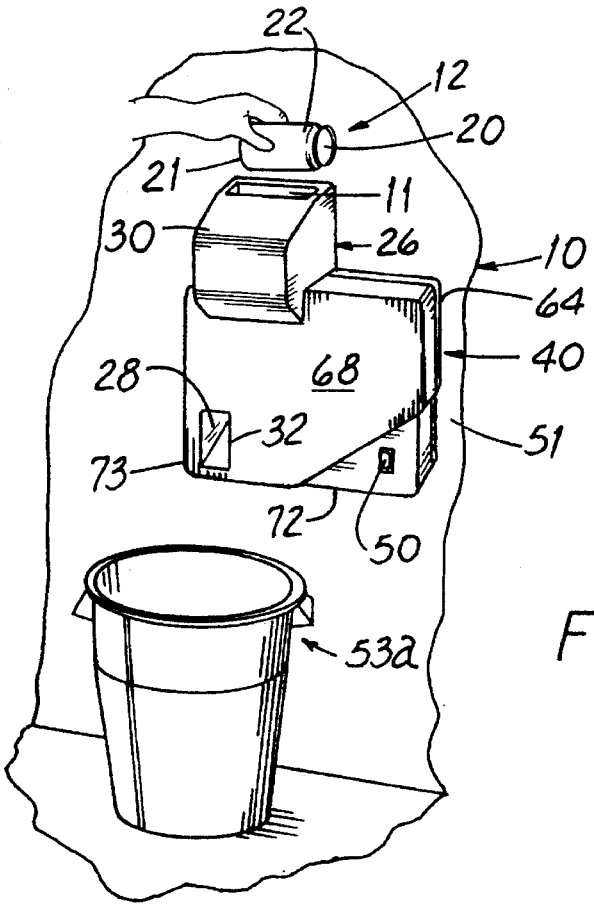
FIG. 1 is a perspective view of the can crusher mounted on a room wall and embodying the features of the invention.

As shown in the drawings for purposes of illustration, the invention is embodied in a can crusher 10 that has an inlet opening 11 through which cans 12 are fed into the can crusher. The can is crushed internally within the can crusher by a piston or ram 14 which is power driven by a drive means 16 that includes an electrical motor 18. Herein, the can is crushed by the ram engaging one end 20 of the can and pushing this end towards the other end 21 of the can to collapse a sidewall 22. The other end of the can is held stationary by a wall 24 in a crushing chamber 25 in which the can is crushed. The can is, in essence, a thin wall, cylindrical column that is collapsed by forces exerted on its ends.

In prior conventional can crushers that had a ram to crush the can, the can crusher had an access door that had to be opened to insert a can and then closed before the can could be crushed. After crushing, the door had to be opened and the can removed before a new can could be inserted. Thus, it was necessary to wait until the previous can was crushed before a new can may be inserted; and this insertion requires both a door opening and the placing of the second can in the crushing chamber. Thus, this conventional can crusher involves a relatively slow and time-consuming process for someone who has a number of cans to crush.

In accordance with the present invention, a plurality of cans, e.g., six (6) cans may be loaded into a can feed hopper 26; and each can 12 rolls in succession into the can crushing chamber 25 where it is crushed; and each crushed can is automatically discharged from a discharge chute 28. The user may place another can in the feed hopper as soon as the first can is crushed.

A person may roll cans into the crushing chamber 25 through a relatively large can feeder opening 11 that is large enough to insert a hand; but the path the can travels is tortuous in the sense that one may not insert one's hand and arm very far without hitting an end wall 30 that blocks further inserting movement. The preferred tortuous or non-linear path involves the cans traveling in a first direction, as shown by the direction arrow A in FIG. 2, and then in an opposite direction, as shown in by the direction arrow B in FIG. 2, until the can drops down into the crushing chamber 25.

The discharge chute 28 for the crushed cans has a discharge aperture 32 which is much smaller in width the can inlet opening 11 so that an adult may not insert his hand through the discharge aperture 32. Although a small hand could be inserted into the aperture, the fingers would abut a non-linear lower chute wall 34 formed of lower wall portions 34*a* and 34*b* oriented in different directions and a non-linear top chute wall 35 formed of corresponding top wall portions 35*a* and 35*b* and be blocked thereby from further straight insertion to the crushing chamber. The preferred discharge chute is non-linear and, in fact, is curved rearwardly and upwardly from the discharge aperture to the crushing chamber 25. Thus, both the hopper feed chute and the discharge chute are non-linear and serve to prevent insertion of human fingers into the crushing chamber. These non-linear paths reduce the length of the chutes from that which would be needed to satisfy Underwriter Laboratories' specifications if the chutes were linear with a straight insertion path into the crushing chamber for human hands.

Figure 3:
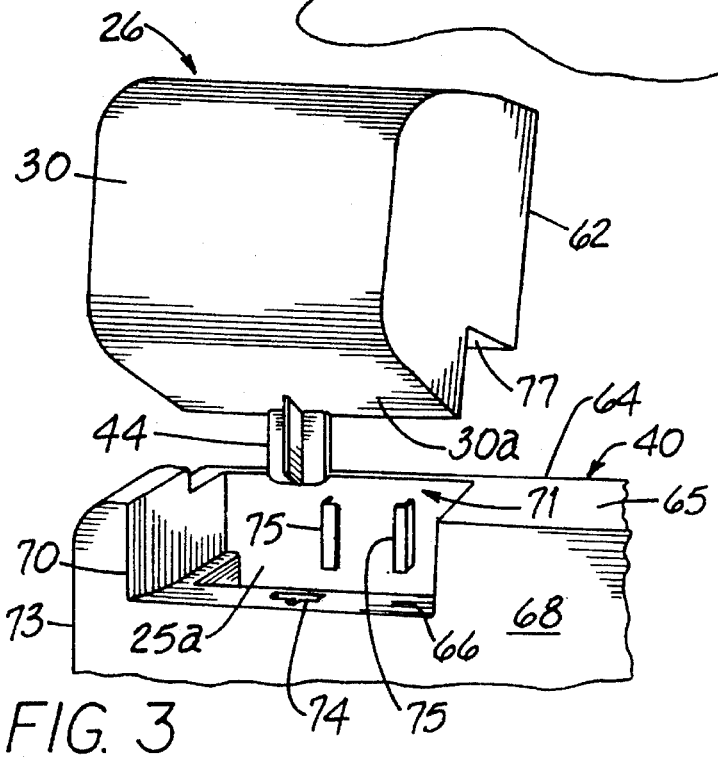
FIG. 3 is a fragmentary view showing the feed hopper being removed from a base unit.
Figure 3A:
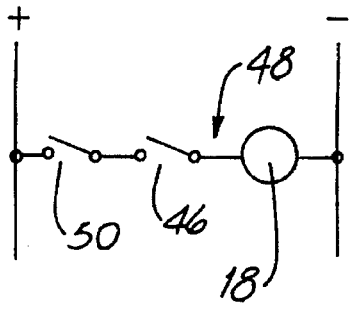
FIG. 3*a* is a schematic view of an electrical circuit for the motor of the can crusher.

It sometimes occurs that a steel can will be rolled into the crushing chamber 25, and that the ram 14 will be unable to crush the steel can because it is too strong a column. The uncrushed steel can will need to be manually removed from the crushing chamber because it is too large to pass through a discharge port or hole 36 in a bottom wall 100 of the crushing chamber. To provide access to the crushing chamber 25, the can feed hopper 26 is detachably mounted to a base unit 40 in which the crushing chamber is located. As best seen in FIG. 3, removal of the can feed hopper from the base unit, leaves the crushing chamber exposed from the top so that a person may grasp the steel can and lift it from the crushing chamber. To prevent an accidental operation of the ram 14 while the hopper 26 is removed and the crushing chamber 25 and ram 14 are exposed, a safety interlock means 42 is provided. The preferred safety interlock means comprises a switch actuator 44 on the can feed hopper that operates an internal, electrical switch 46 in an electrical circuit 48 to disable the drive means 16 and electric motor 18 for as long as the hopper is detached. When the hopper is re-attached, the actuator 44 actuates the electrical switch 46 to enable the electrical circuit for the drive means 16 and the motor 18 to allow the ram to be driven to again crush cans. The electrical circuit for the motor also includes a manually-operated, on-off switch 50 on the base unit. When the switch 50 is in its "on" position, the ram continually reciprocates through crushing cycles. When this switch 50 is in the "off" position, the electrical circuit for the electrical motor is disabled.

In the preferred embodiment of the invention, the can crusher 10 may be mounted on a room wall 51 (FIG. 1) with a rear side 64 of the crusher housing flat against the room wall. The cans are fed through the upper inlet 11 and travel by gravity into the underlying crushing compartment 25; and, after crushing, fall by gravity through the discharge chute 28 located at a lower portion of the housing into a recycling container 53*a*. Preferably, the can inlet is at the upper side of the housing; and the discharge aperture 32 is at the lower portion of the housing, and in the front wall 68 of the housing.

The can crusher may be set upon a counter 55 (FIG. 2) resting on the bottom side 72 of the housing or it may be mounted on the wall, as shown in FIG. 1.

In this illustrated can crusher 10, the cans travel in a generally downward path without being shifted axially. That is, the left end 21 of the can, as viewed in FIGS. 2 and 3, travels in a substantially vertical plane in its travel through the can crusher. This left can, end first, falls down along a vertical hopper sidewall 53 from the inlet opening 11, as it rolls down to a position adjacent the crushing chamber's stationary end wall 24, and then falls down along chute sidewall 54, which ends at the discharge aperture 32. The inlet hopper sidewall 53, the chamber end wall 24 and the discharge chute sidewall 54 are generally aligned in a vertical plane so that the can end 21 travels generally in a vertical plane as it travels through the can crusher.

Referring now in greater detail to the preferred and illustrated embodiment of the invention, the feed hopper includes a molded plastic housing which has a curved front wall 30 extending from the top inlet opening 11 down to a lower end 30*a*. The cans roll down an inclined divider plate 60 within the hopper to reverse their direction of travel when they leave the edge 60*a* of the inclined divider plate and hit the inside surface of the curved wall 30. The inclined divider wall 60 extends forwardly and at a slight slope and has the forward edge 60*a* spaced from the curved wall 30 by a distance greater than a can diameter so that a can may travel past the edge 60*a*, and then abut and be guided by the lower portion of the curved wall 30 for reverse direction travel beneath the divider plate towards crushing chamber 25.

Figure 4:
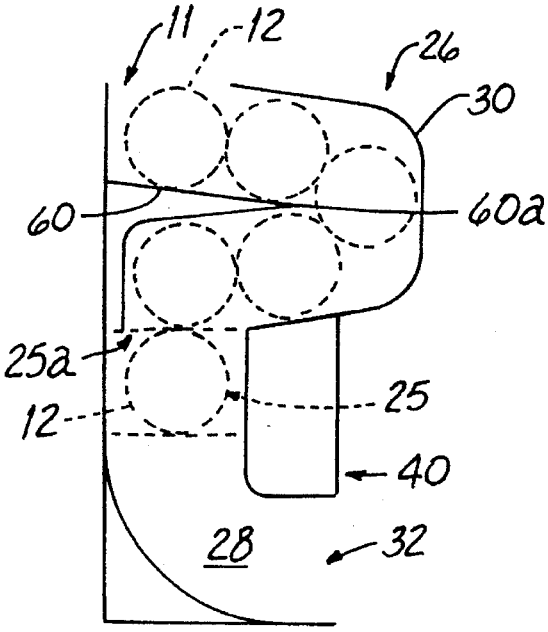
FIG. 4 is a cross-section through the can crusher showing a can travel path.
Figure 5:
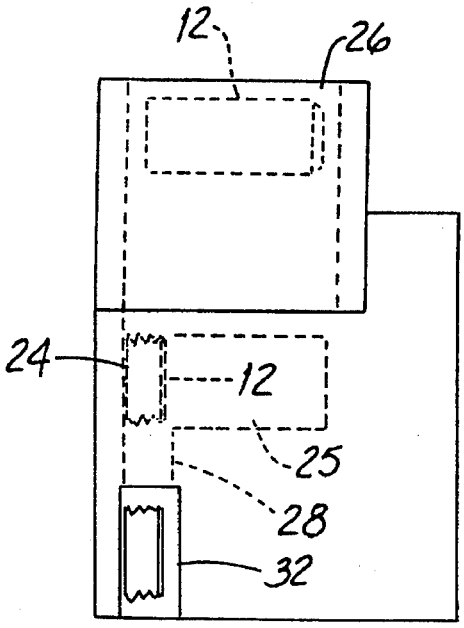
FIG. 5 is a diagrammatic view showing the vertical drop of the can through the can crusher.
Figure 2:
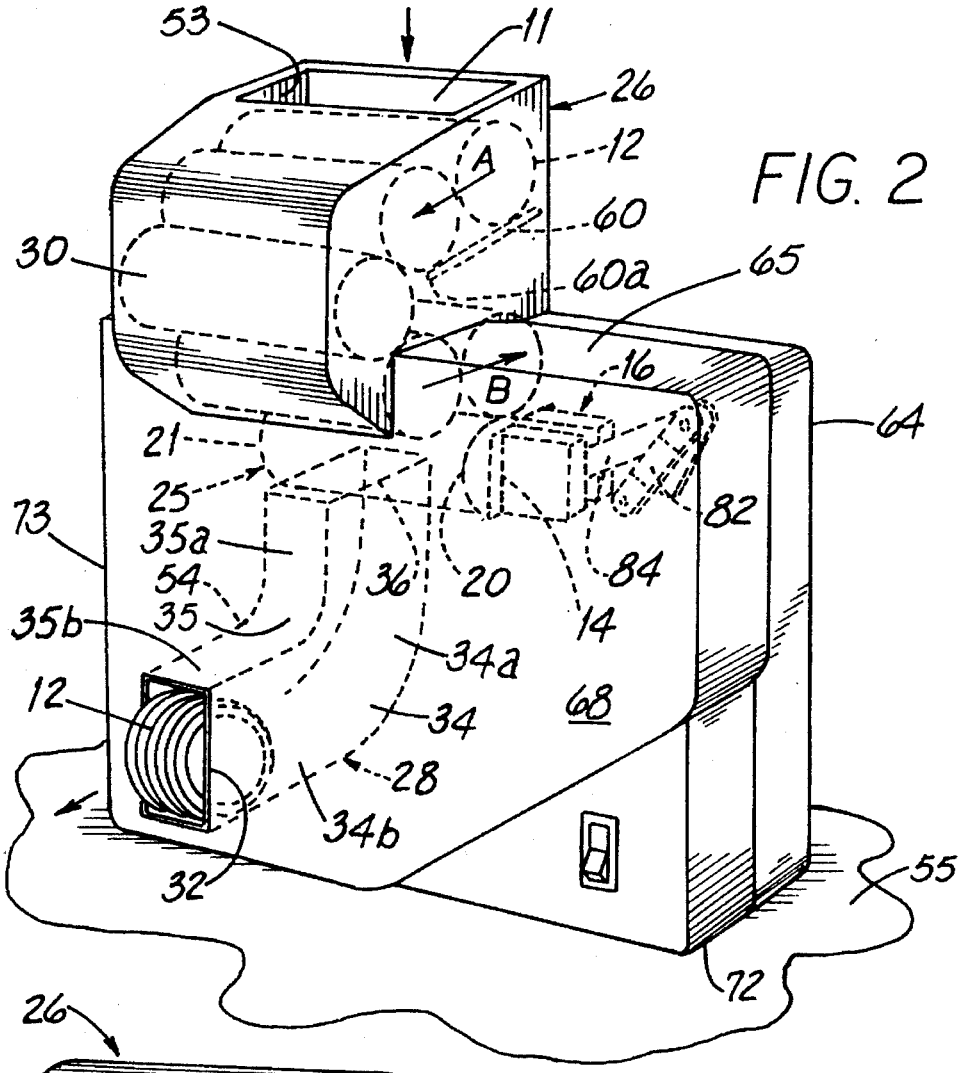
FIG. 2 is an enlarged, perspective view of the can crusher of FIG. 1 showing cans in the feed hopper and the crushing station, and showing a crushed can being discharged.

The hopper 26 also includes a rear wall 62 that is aligned with and is in the same vertical plane as rear wall 64 of the base unit. These walls 62 and 64 are called rear walls because the unit may be mounted on a room wall 51, as shown in FIG. 1, in which case these walls are abutted against a room wall 51. The curved hopper wall 30 guides cans to engage an inlet ledge 66 on the base unit just before the top opening 25*a* (FIGS. 3 and 4) into the crushing chamber 25. As best seen in FIGS. 2 and 3, the first inserted can rolls down in the inlet chute across the inlet ledge 66 to drop through the opening 25*a*, and fall down into the crushing chamber 25. The second can rolls the same path to a position at the opening 25*a*, and comes to rest at and to sit upon the first can. Another four cans, as shown in FIG. 2, may be inserted into the hopper and they will abut each other and assume the positions shown in FIG. 2.

To accommodate the inflow of cans 12 from the feed hopper into the crushing chamber, the base unit 40 has a front wall 68 with a side cut-out 70 through which the cans pass. This cut-out 70 is covered by the lower end 30*a* of the curved hopper wall 30. The base unit has a front wall 68 which is generally a vertical wall that is parallel to the base rear wall 64. The base unit also has a top wall 65 parallel to a base bottom wall 72. The base unit also has vertical end walls 73. Vertical front 68 and rear 64 walls are substantially larger in width than vertical end walls 73.

Rather than being mounted on a room wall, the bottom wall 72 may be seated on a counter or table. The top wall has a cut-out 71 above the crushing station to allow access to a steel can or the like in the crushing station when the hopper is removed, as is being done in FIG. 3. The hopper is configured at its lower end to rest on top of the base unit and to cover the crushing chamber.

The preferred safety interlock includes the T-shaped switch actuator 44 projecting downwardly from the bottom of the hopper and its lower curved wall 30*a*. A mating T-shaped slot 74 is provided in the ledge 66 in the base unit. Also, to connect the hopper to the base unit, the base unit has a pair of dovetail projections 75 on the interior side of the rear wall 64 of the base unit. These dovetail projections 75 have a sliding fit with slots (not shown) in the rear wall 62 of the hopper. The wider outer part of the dovetail projections abut the inside of the rear wall 62 of the hopper 26 with a narrow neck of the T-shaped cross-section dovetails being fitted in the slots (not shown) in the rear wall 62. When the dovetail projections 75 slide in the slots in the hopper rear wall 62, and the T-shaped actuator 44 slides down into the T-shaped slot 74 in the ledge 66, the hopper 26 will be connected and stabilized against tipping or rocking and will be aligned in proper position over the crushing chamber.

The preferred and illustrated drive means 16 includes the electric motor 18 and a series of gears in a gear train 80 (FIG. 7) which drive a pair of crank bars or arms 82 and 82*a* which are connected by a connecting rod 84 (FIG. 6) to the piston or ram 14. The connecting rod 84 is pivotally connected at one end 84*a* to the piston ram 14 at pivot pin 90 which extends horizontally through the piston ram 14. The other end 84*b* of the connecting rod is sandwiched between the upper ends of a pair of crank arms 82 and 82*a*; and a pivot pin 91 is bolted through the crank arms and the upper connecting rod end 84*b*. The crank arm 82*a* has its lower end pivoted at a pivot pin 93 in a boss 95 in a molded subframe 97. The other crank arm 82 has its lower end fastened to a horizontal drive shaft 83*i* to which is affixed the output drive gear 83*g* for the crank arm 82. Thus, as the gear 83*g* rotates, the upper end of the crank arm 82 and attached upper ends of the connecting rod 84 and crank arm 82*a* oscillate forwardly and rearwardly to reciprocate the piston ram 14.

The drive means 16 includes the electric motor 18 which is mounted on the subframe 97 with its output shaft 81 horizontal and driving fixedly attached pinion gear 83. The gear train for reducing the speed includes a second large gear 83*a* fixed to a shaft 83*b* on which is also fixedly mounted a smaller gear 83*c*. The shaft 83*b* is journaled for turning in the subframe 97. The gear 83*c* drives a very large gear 83*d* mounted on a horizontal shaft 83*f* journaled in the subframe. A smaller gear 83*h* is mounted on the shaft 83*f*, and it is meshed with the output drive gear 83*g* which is fixed to the drive shaft 83; which extends through the boss 85 in the subframe 97 and has a flattened end connected to the lower end of the crank arm 82 to oscillate the crank arm 82 attached thereto.

The gear train is provided to allow the motor to turn at high speed and to generate the torque needed to be applied to the crank arms and connecting rod to push the piston ram 14 to apply a force in excess of 200 lbs. to the can end 20. The illustrated electric motor is a 1/15 horsepower, electric motor.

Figure 6:
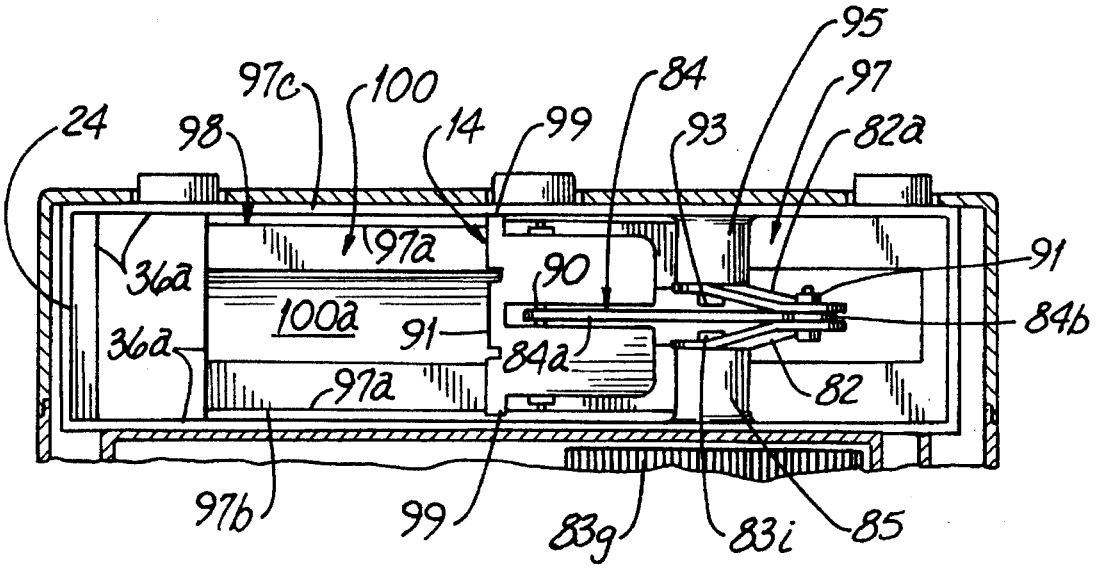
FIG. 6 is a cross-sectional, plan view of the crushing chamber and ram and of the ram drive.

The subframe 97 includes an upper horizontal, molded piece 98, as best seen in FIG. 6, which includes the bottom wall 100 for the crushing chamber 25 with a concave central depression 100*a* to receive the curved lower portion of the cylindrical can. The discharge port 36 is formed in the bottom wall and bounded by edges 36*a* (FIG. 6) in the subframe 97. The piston ram 14 is a generally block-shaped member having a slot receiving the lower end of the connecting rod 84 which is pivoted about in the middle of the block-shaped ram 14. The ram has its lower end formed to mate with and slide along the bottom wall 100 of the crushing chamber 25. The piston ram is guided for rectilinear, reciprocating travel by a pair of lateral ears 99 thereon that slide in slots 97*a*formed in vertical sidewalls 97*b* and 97*c* of the subframe. The slots 97*a* are formed in the longitudinal direction and along the lower portions of the crushing chamber sidewalls 97*b* and 97*c*.

Figure 7:
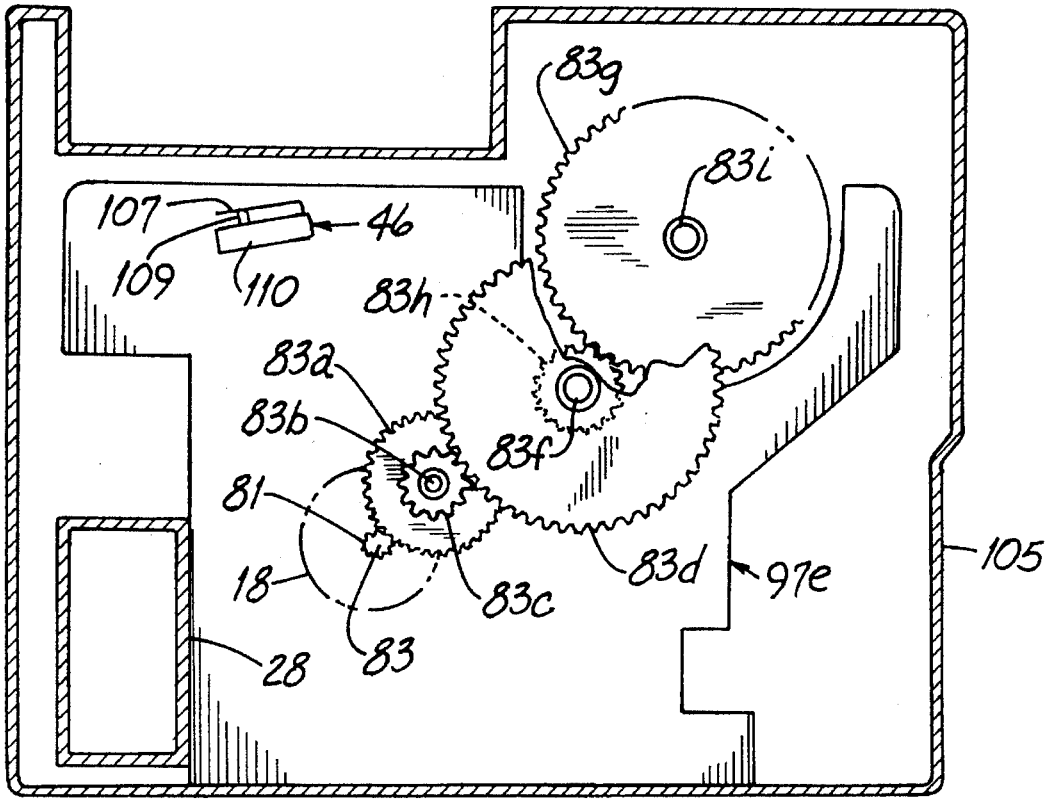
FIG. 7 is a cross-sectional elevational view of the gear train drive mounted on a subframe in the housing.

The subframe 97 also has a lower vertical section 97*e* (FIG. 7) in which are journaled the respective gear shafts 83*b* and 83*f*. The motor 18 is mounted on the reverse side of vertical subframe section 97*e*, as shown in FIG. 7, and is centered about its output shaft 81. The motor 18 is disposed directly beneath the bottom wall 100 of the crushing chamber 25. This internal subframe 97 with its lower section 97*e* is bolted to and stationary with respect to outer housing 105 which encloses the same and forms therewith the lower base unit frame structure to withstand the loads encountered when crushing cans.

The interlock switch 46 is mounted on the subframe section 97*e* and includes an upper pivoted lever 107 which pushes on a cam 109 which projects internally within a switch housing 110 having electrical contacts (not shown) therein. The interlock switch is fastened to the subframe which has the ledge 66 and the T-shaped slot 74 therein directly above the interlock switch 46.

When a steel can is attempted to be crushed, the steel can will be compressed slightly in the axial direction, and the motor torque will be overcome, and the motor will then stall out. The force of the compressed can will immediately expand the can slightly when the ram's motor force is released thereby pushing the ram rearwardly, and thereby through the crank arms, turn the gears and shafts 81, 83 in the reverse direction and, as a result, turn the motor shaft in the reverse direction. Thus, the piston ram will not be tightly held against the can end and jamming the can against the other end wall 24 of the crushing chamber, as would preclude an easy lifting of the steel can from the crushing compartment. The backing off of the ram should preclude persons from taking a screw driver or the like and trying to pry the can loose, as they may try to do if the can were jammed in the chamber and not loose for removal. The screw driver may puncture a can and release any liquid therein. The primary safety concern of using a screw driver to pry a can loose is that a person may puncture a can, causing the contents of the can to spray under pressure into the eyes of such person. In the prior art, the gear units were such that they would not automatically reverse; and it was very difficult to remove a steel can that became jammed in the can crusher.

Turning now to the preferred method of operation, cans 12 are fed one after another into the feed hopper 26 through the inlet opening 26. The cans roll down the inclined divider to the curved wall 30, and then are guided in the reverse direction into a position above the crushing chamber 25. The first can drops down into the crushing chamber and the second can rolls onto the top of the first can. Herein, another four cans may be loaded into the hopper. With operation of the switch 50, to the "on" position, the electric motor 18 operates its drive means 16 to slide the piston ram 14 to abut the adjacent end 20 of the can to push the can end 21 against the chamber end wall 24, and continued piston force crushes the cylindrical wall 22 of the can as the axially-directed force on the can end pushes the can end 20 toward the other stationary end 21 of the can. The can length between its ends 20 and 21 is reduced to about one-fourth (¼) of its original length and to a length less than the width of a discharge port or opening 36; so that as the piston ram retracts and releases its endwise force on the crushed can, it is free to drop down into the discharge chute 28 to travel along a curved path of travel and to automatically drop from the discharged aperture 32 into a container 53 or the like.

As the first can is crushed and drops, the second can is now released to drop into the crushing chamber 25, and the other cans also roll, with the third can rolling onto the top of the second can. Thus, there is a new space adjacent the hopper inlet to receive a new can in the hopper. With each stroke of the ram, a new can is crushed and dropped into the discharge chute until the hopper is emptied or until the switch 50 is moved to the "off" position.

If a steel can were inserted into the hopper, it would travel to the crushing chamber 25; and the ram 14 would not have sufficient force to collapse its cylindrical wall to reduce it to the size needed to drop the can through the discharge opening into the discharge chute 28. The steel can will expand in the return axial direction when the electrical motor stalls out. In such situations, the gears and shafts 83 are turned and rotate the motor shaft 81 sufficiently that the steel can will not be tightly wedged in the crushing chamber.

The operator may then lift the hopper unit with the T-shaped actuator projection 44 being lifted from the T-shaped slot 74 in the ledge, and with the sides of the hopper guide slots 76 sliding along the dovetails 75 on the interior side of the base rear wall 64. As the projection actuator moves upwardly, the electrical unit switch 46 within the motor electrical circuit is opened to disable the electric motor. The steel can may be lifted by a person from the crushing chamber and the hopper 26 repositioned onto the base unit. The actuator, when inserted into the base unit slot 74, will abut the electrical switch 46 to enable the motor circuit 48. If the switch 50 is in the "on" position, the can crusher motor 18 will begin to drive the drive means 16 to move the ram 14 to crush the next can fed by the hopper into the crushing chamber.

From the foregoing, it will be seen that there is provided a new and improved can crusher for home usage to crush aluminum cans. The can crusher is efficient to use because cans may be inserted into the feed hopper through an open inlet and fed automatically to be crushed and to be discharged. The can crusher is designed to be safe to prevent insertion of human fingers through either the inlet or discharge apertures and into the crushing chamber while the can crusher is enabled to drive the ram. To remove a jammed can, the feed hopper is detached, thereby exposing the jammed can and the crushing chamber. Removal of the feed hopper disables the electrical circuit for the drive motor which cannot be restarted until the can hopper is returned, and the actuator operates the electrical switch in the motor's electrical circuit. The can crusher may be mounted on a room wall or it may be set upon a counter, table or the like. Preferably, the cans fall by gravity through the can crusher in a generally vertical path without being displaced axially to provide an automatic infeed of cans to the crushing compartment and an automatic discharge of crushed cans.

What is claimed is:

1. A can crusher for power crushing a sequence of cans inserted therein and for automatically discharging cans crushed in the lengthwise direction, said can crusher comprising:

a lower base unit having vertical end walls and front and rear vertical walls substantially larger in width than the vertical end walls;

an upper can feed hopper detachably mounted on the lower base unit;

first walls including a sloped wall in the upper can feed hopper defining a downwardly sloped first path in a first direction for supporting a first, single row of cans;

second walls including a second sloped wall in the upper can feed hopper defining a reversely sloped path beneath the first path and being sloped in a reverse direction to the first direction for supporting a second, single row of cans beneath the first row of cans;

a crushing station in the base unit for receiving cans discharging from the second row on the second sloped wall in the detachable can feed hopper;

the crushing station being accessible with removal of the upper can feed hopper from the lower base unit for removal of a can therein;

a power driven ram in the lower base unit movable to engage an end of a can in the crushing station to crush the can lengthwise to reduce its length; and walls in the lower base unit defining a curved discharge chute leading from the crushing chamber to a discharge aperture through which the crushed cans are discharged, the discharge aperture being in the lower base front wall.

2. A can crusher in accordance with claim 1 in which the discharge aperture has a height slightly greater than the diameter of a can and a width slightly greater than the thickness of a crushed can.

3. A can crusher in accordance with claim 1 in which the feed hopper is wider than the lower base unit with cans in the hopper unit being positioned outside of the lower base unit's width in their travel to the crushing chamber.

4. A can crusher in accordance with claim 1 in which a safety interlock is actuated by removal of the can feed hopper to prevent operation of a crushing ram, while a person's fingers are at the crushing station removing a can therefrom.

5. A can crusher in accordance with claim 4 further including an electric motor coupled to the power driven ram and an electric motor circuit, the safety interlock comprising an electrical switch in the electric motor circuit and an actuator on the can feed hopper to actuate the electric switch to enable the electric motor circuit when the can feed hopper is attached to the base unit and to disable the electric motor circuit when the can feed hopper is detached from the base unit.

6. A can crusher in accordance with claim 5 in which the actuator comprises a projection on the can feed hopper, and a slot in the base unit accepts the projection which moves through the slot to a position internally within the base unit to engage the electrical switch in order to enable the electric motor circuit.

7. A can crusher for power crushing of a sequence of cans inserted therein and for automatically discharging cans crushed in the lengthwise direction, said can crusher comprising:

a lower base unit;

an upper can feed hopper detachably mounted on the lower base unit;

first walls including a sloped wall in the upper can feed hopper defining a downwardly sloped first path in a first direction for supporting a first, single row of cans;

second walls including a second sloped wall in the upper can feed hopper defining a reversely sloped path beneath the first path and being sloped in a reverse direction to the first direction for supporting a second, single row of cans beneath the first row of cans;

a crushing station in the base unit for receiving cans discharging from the second row on the second sloped wall in the detachable can feed hopper;

the crushing station being accessible with removal of the upper can feed hopper from the lower base unit for removal of a can therein;

a power driven ram in the lower base unit movable to engage an end of a can in the crushing station to crush the can lengthwise to reduce its length; and walls in the lower base unit defining a non-linear discharge chute leading from the crushing chamber to a discharge aperture through which crushed cans are discharged, said lower base unit walls including a non-linear lower chute wall formed of lower wall portions oriented in different directions and a non-linear top chute wall formed of corresponding top wall portions, each lower wall portion spaced from and extending in the same direction as one of the corresponding top wall portions;

whereby a person's hand is obstructed from entering the crushing chamber through the hopper and discharge chute during can crushing.

8. A can crusher in accordance with claim 7 in which the feed hopper is wider than the lower base unit with cans in the hopper unit being positioned outside of the lower base unit's width in their travel to the crushing chamber.

9. A can crusher in accordance with claim 7 in which the lower base unit has vertical end walls and has front and rear vertical walls substantially larger in width than the vertical end walls, the discharge aperture being in the front wall, and wherein the discharge chute along which the crushed can rolls from the crushing chamber to the discharge aperture is curved.

10. A can crusher in accordance with claim 7 in which a safety interlock is actuated by removal of the can feed hopper to prevent operation of a crushing ram, while a person's fingers are at the crushing station removing a can therefrom.

11. A can crusher in accordance with claim 10 further including an electric motor coupled to the power driven ram and an electric motor circuit, the safety interlock comprising an electrical switch in the electric motor circuit and an actuator on the can feed hopper to actuate the electrical switch to enable the electric motor circuit when the can feed hopper is attached to the base unit and to disable the electric motor circuit when the can feed hopper is detached from the base unit.

12. A can crusher in accordance with claim 11 in which the actuator comprises a projection on the can feed hopper, and a slot in the base unit accepts the projection which moves through the slot to a position internally within the base unit to engage the electrical switch in order to enable the electric motor circuit.

* * * * *